US009962582B2

(12) United States Patent
Antku

(10) Patent No.: US 9,962,582 B2
(45) Date of Patent: May 8, 2018

(54) GOLF CLUB CROWN ALIGNMENT, AIMING AND SHOT SHAPING AID

(71) Applicant: Charles T. Antku, Oakdale, NY (US)

(72) Inventor: Charles T. Antku, Oakdale, NY (US)

(73) Assignee: Charles T. Antku, Oakdale, NY (US)

( * ) Notice: Subject to any disclaimer, the term of this patent is extended or adjusted under 35 U.S.C. 154(b) by 0 days. days.

(21) Appl. No.: 15/391,490

(22) Filed: Dec. 27, 2016

(65) Prior Publication Data

US 2017/0197118 A1 Jul. 13, 2017

Related U.S. Application Data

(60) Provisional application No. 62/387,417, filed on Dec. 24, 2015.

(51) Int. Cl.
*A63B 53/06* (2015.01)
*A63B 57/00* (2015.01)
*A63B 53/04* (2015.01)

(52) U.S. Cl.
CPC .. *A63B 53/0466* (2013.01); *A63B 2053/0437* (2013.01); *A63B 2053/0441* (2013.01)

(58) Field of Classification Search
USPC ..... 473/238, 252–254, 324–350, 219; D21/742, 751
See application file for complete search history.

(56) References Cited

U.S. PATENT DOCUMENTS 1,485,272 A * 2/1924 Kinsman ..... A63B 69/3632 473/242
2,859,972 A * 11/1958 Reach ..... A63B 53/04 473/242

(Continued)

FOREIGN PATENT DOCUMENTS

GB 2299513 A * 10/1996 ..... A63B 43/008

OTHER PUBLICATIONS

T. Beach, "GolfWRX Tech Talk:'13 TMag R1 Driver—YouTube", YouTube Video found on the Internet at: https://www.youtube.com/watch?v=YF8AZhccRJM, TaylorMade metalwoods, published Jan. 2, 2013, retrieved Jun. 25, 2015, pp. 1-2.

(Continued)

*Primary Examiner* — Alvin Hunter
(74) *Attorney, Agent, or Firm* — Norris McLaughlin & Marcus PA

(57) ABSTRACT

A golf club head of a non-putter golf club comprising a crown and a sole located opposite the crown, a heel end and a toe end located opposite the heel end, a striking surface, and a design applied to the crown, which design comprises: a vertical line parallel to the striking surface, and a first set of diagonal lines consisting of one or more entirely straight lines, wherein: a) none of the lines of the first set of diagonal lines is parallel or perpendicular to the vertical line, b) no two lines of the first set of diagonal lines are parallel or perpendicular to each other, c) each line of the first set of diagonal lines forms an acute angle with a plane parallel to the striking surface, which plane passes through the end-point of said line located nearer to the striking surface, and d) the lines of the first set of diagonal lines converge towards the heel end, and diverge towards the toe end.

18 Claims, 19 Drawing Sheets
(17 of 19 Drawing Sheet(s) Filed in Color)

(56) References Cited

U.S. PATENT DOCUMENTS

| | | | | | |
|---|---|---|---|---|---|
| 2,934,347 | A * | 4/1960 | Siniscalchi | A63B 69/3632 | 473/242 |
| D205,041 | S * | 6/1966 | Capps | 473/252 | |
| 3,753,564 | A * | 8/1973 | Brandell | A63B 69/3614 | 473/220 |
| 3,826,495 | A * | 7/1974 | Elkins, Jr. | A63B 69/3614 | 473/409 |
| 4,128,244 | A * | 12/1978 | Duclos | A63B 53/0487 | 473/242 |
| 4,174,839 | A * | 11/1979 | Marrs | A63B 69/3685 | 473/252 |
| 4,659,083 | A * | 4/1987 | Szczepanski | A63B 69/3685 | 473/252 |
| 4,753,440 | A * | 6/1988 | Chorne | A63B 69/3632 | 473/242 |
| 4,795,157 | A * | 1/1989 | Bencriscutto | A63B 69/3685 | 473/251 |
| 4,819,943 | A * | 4/1989 | Szczepanski | A63B 69/3685 | 473/252 |
| 5,433,446 | A * | 7/1995 | Lindstedt, Jr. | A63B 69/3632 | 473/242 |
| 5,839,970 | A * | 11/1998 | Lombardo | A63B 69/3685 | 351/178 |
| 6,062,986 | A * | 5/2000 | Kaise | A63B 53/0487 | 473/242 |
| 6,224,494 | B1 * | 5/2001 | Patsky | A63B 53/04 | 473/253 |
| 6,244,974 | B1 * | 6/2001 | Hanberry, Jr. | A63B 53/007 | 473/242 |
| 6,605,006 | B2 * | 8/2003 | Mason | A63B 53/04 | 473/252 |
| 6,659,882 | B2 * | 12/2003 | Patsky | A63B 53/04 | 473/292 |
| 7,077,757 | B1 * | 7/2006 | Payne | A63B 53/04 | 473/238 |
| 7,172,513 | B1 * | 2/2007 | Rinker | A63B 53/065 | 33/508 |
| 7,371,184 | B2 * | 5/2008 | Tao | A63B 53/0487 | 473/242 |
| 7,374,497 | B2 | 5/2008 | Brown | | |
| 7,399,233 | B2 | 7/2008 | Pollman | | |
| 7,481,715 | B2 | 1/2009 | Byrne | | |
| 7,828,669 | B1 * | 11/2010 | Stites | A63B 53/0466 | 473/219 |
| 8,235,830 | B2 | 8/2012 | Stites | | |
| 8,246,481 | B2 * | 8/2012 | Stites | A63B 53/007 | 473/242 |
| 8,414,410 | B1 | 4/2013 | Flaherty et al. | | |
| 8,425,341 | B2 * | 4/2013 | Takechi | A63B 53/0466 | 473/242 |
| 8,545,340 | B2 | 10/2013 | Roach et al. | | |
| 8,556,742 | B2 | 10/2013 | Stites | | |
| 8,608,587 | B2 * | 12/2013 | Henrikson | A63B 53/0466 | 473/324 |
| 2002/0049096 | A1 * | 4/2002 | Doolen | A63B 53/04 | 473/330 |
| 2007/0004525 | A1 | 1/2007 | Lee et al. | | |
| 2007/0238544 | A1 | 10/2007 | Jazwiec | | |
| 2009/0215547 | A1 | 8/2009 | Hegarty | | |
| 2010/0323806 | A1 | 12/2010 | Stites | | |
| 2011/0059808 | A1 | 3/2011 | Roach | | |
| 2012/0270672 | A1 | 10/2012 | Velasquez | | |
| 2013/0012331 | A1 | 1/2013 | Goldsmith et al. | | |

OTHER PUBLICATIONS

"2013 TaylorMade R1 Driver: Editor Review | GolfWRX", found on the Internet at: http://www.golfwrx.com/57945/2013-taylormade-r1-driver/, retrieved Jun. 25, 2015, pp. 1-59.

"True Aim: The Next Big Innovation in Driver Technology", found on the Internet at: http://forum.mygolfspy.com/topic/4744-true-aim-the-next-big-innovation-in-driver-technology, Dec. 12, 2011, pp. 1-13, retrieved Jun. 25, 2015.

"Odyssey Big T putters aim to make alignment even easier | GolfWRX", found on the Internet at: http://www.golfwrx.com/306898/odyssey-big-t-putter-aim-to-make-alignment-even-easier/, retrieved Jun. 25, 2015, pp. 1-9.

* cited by examiner

S – Square (101)

+1 – Soft Draw (102)

+2 – Full Draw (102)

+3 – Hood (102)

-1 – Fade (102)

FIGURE 13 A
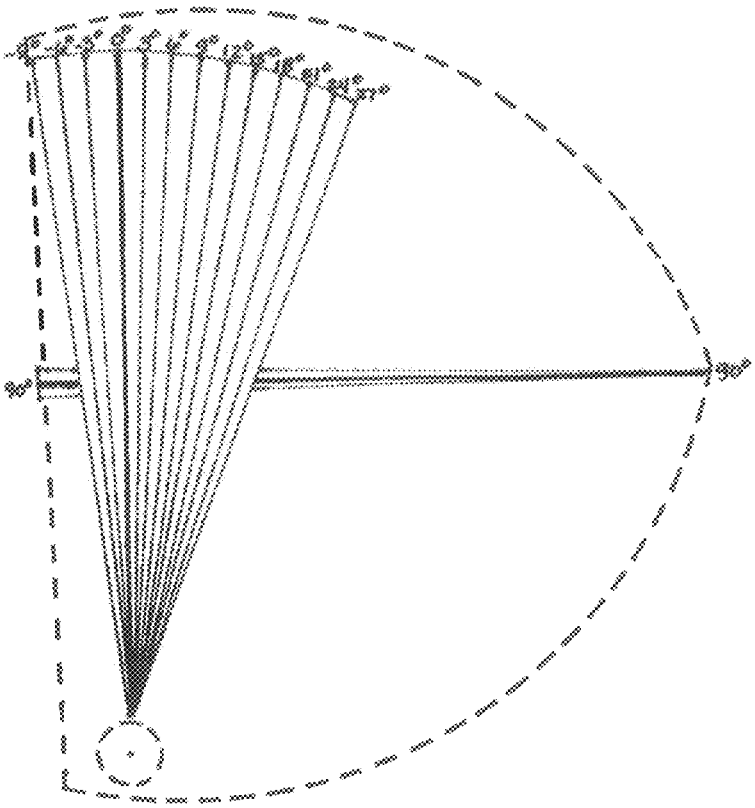
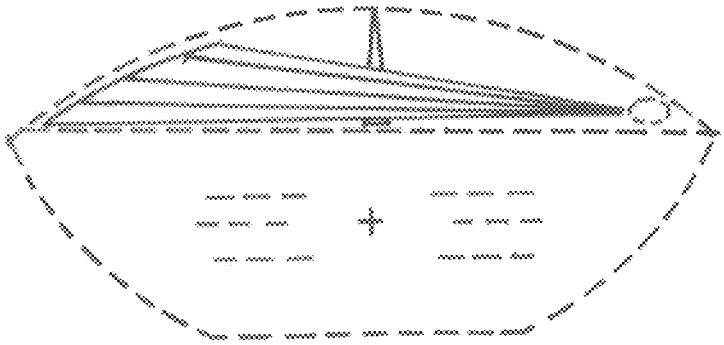
FIGURE 13 B

GOLF CLUB CROWN ALIGNMENT, AIMING AND SHOT SHAPING AID

This application claims benefit of U.S. Provisional Application No. 62/387,417, filed Dec. 24, 2015, the disclosure of which is incorporated by reference herein in its entirety.

FIELD OF THE INVENTION

This application relates to a golf club or golf club head and designs for a virtual reference guide which may be applied to the crown thereof or form a part thereof for facilitating golf shot alignment, aiming and shaping.

BACKGROUND OF THE INVENTION

Numerous designs for application to a golf club had been proposed for facilitating and improving a player's golf game. Many such designs are specific to clubs designed for use in putting, which involve relatively short and low-speed strokes with the intention of rolling the ball into the hole from a short distance away. Putters are differentiated from non-putter clubs, the designs of which are the subject of the present invention, by a club head with a very flat, low-profile, low-loft striking face, and by other features which are only allowed on putters, such as bent shafts and non-circular grips. Designs specific to putters such as that described in U.S. Pat. Nos. 7,374,497, 7,399,233 and 8,246,481 and U.S. Patent Application Publication No. 2007/0238544, are outside the scope of the present invention.

Designs for application to crowns of non-putter clubs are discussed in, e.g., U.S. Pat. Nos. 7,481,715, 8,235,830, 8,414,410, 8,545,340 and 8,556,742 as well as U.S. Patent Application Publication Nos. US 2007/0004525, US 2009/0215547, US 2012/0270672 and US 2013/0012331.

U.S. Pat. No. 8,545,340 teaches use of directional based graphic on golf clubs, which can become invisible/visible depending on the angle from where the graphic is viewed. FIGS. 7-9 of the '340 Patent show the graphic applied to the crown of the club head. In paragraph [0046], it is stated that the directional based graphic display may be used to determine variations in lie angle or loft angle. In paragraph [0051], it is stated that the directional based graphic could relate generally to any sort of visual illustrations and can refer to " . . . an alignment line . . . ." However, there is no teaching regarding the specific configuration of such "an alignment line" nor that there could be a plurality of lines.

US 2009/0215547 relates to rectangular markers, which do not comprise diagonal, non-parallel and non-perpendicular lines, applied to the club head.

U.S. Pat. No. 7,481,715 teaches making the actual face angle of the golf club appear differently when the golf club is at address, by employing an alignment line located at the junction of the crown and the striking surface. This line is not applied to the crown, and is clearly not diagonal. In column 2 the patent further states that "[t]he golf head can also include a second line perpendicular to the alignment line". Clearly, the design of the '715 Patent also does not comprise diagonal, non-parallel and non-perpendicular lines, applied to the club head.

Other designs comprise only parallel diagonal lines. Such clubs include, e.g., a commercially available club known as "2013 TaylorMade R1 Driver" sold by the Taylor Made Golf Company, Inc. and clubs described in U.S. Pat. No. 8,414,410 (see FIG. 4 of the '410 Patent).

US 2012/0270672, US 2007/0004525, US 2013/0012331 teach clubs with various markings applied to the crown of the club head, which markings include non-parallel diagonal lines. The most relevant figures are FIGS. 6b-6c of US 2007/0004525, FIGS. 11 and 12 of US 2013/0012331, and FIG. 4 of Patent US 2012/0270672. However, these designs do not contain a vertical line and/or entirely straight diagonal lines. Moreover, the lines are part of a design intended to direct a golfer's attention to a specific spot in on the striking surface so as facilitate repeated contact at the same desired location, rather than to allow the golfer to recognize and modify the alignment of clubface at each address, depending on the desired flight trajectory.

U.S. Pat. No. 8,235,830 also teaches markings applied to the crown of the club head, which include non-parallel diagonal lines. The most relevant markings are shown in FIGS. 4-9. However, these diagonals lines do not converge towards the heel end, and diverge towards the toe end. Moreover, the design of US 2010/0323806 is configured to signal the proper take-away ("visual swing indicator"), so as to facilitate backswing along the same desired path, rather than to allow the golfer to recognize and modify the alignment of clubface at each address, depending on the desired flight trajectory.

U.S. Pat. No. 8,556,742 updates the design of, and is by the same applicant/inventor as U.S. Pat. No. 8,235,830. Additional configuration of the "visual swing indicator" is shown in FIGS. 10-13. However, these lines do not appear to be entirely straight and again are part of a design configured to signal the proper take-away, so as to facilitate backswing along the same desired path, rather than to allow the golfer to recognize and modify the alignment of clubface at each address, depending on the desired flight trajectory.

SUMMARY OF THE INVENTION

Disclosed are non-putter golf clubs, e.g., drivers, fairway woods or metals, and rescue/utility clubs, and club heads having novel designs that provide a means to accurately, consistently and repeatedly set the clubface at address. The designs described herein provide visual reference guides that allow golfers to recognize and adjust the face angle of the club to suit their needs (align, aim, straighten or shape their shot) and the requirements of the shot (fade, draw, straight). In so far as applicant is aware, there are no prior art golf club designs which includes alignment and aiming aids substantially as described herein. Previously known designs as discussed hereinabove do not include lines for aiding adjustment of clubface for hitting different types of golf shots in a consistent manner.

BRIEF DESCRIPTION OF THE DRAWINGS

The patent or application file contains at least one drawing executed in color. Copies of this patent or patent application publication with color drawings(s) will be provided by the Office upon request and payment of the necessary fee.

FIG. 13*a*: shows a top-side view of a golf club having a design in accordance with an embodiment of the present invention.

FIG. 13*b*: shows a front view of a golf club corresponding to the embodiment of FIG. 13*a*.

DETAILED DESCRIPTION

Figure 1:
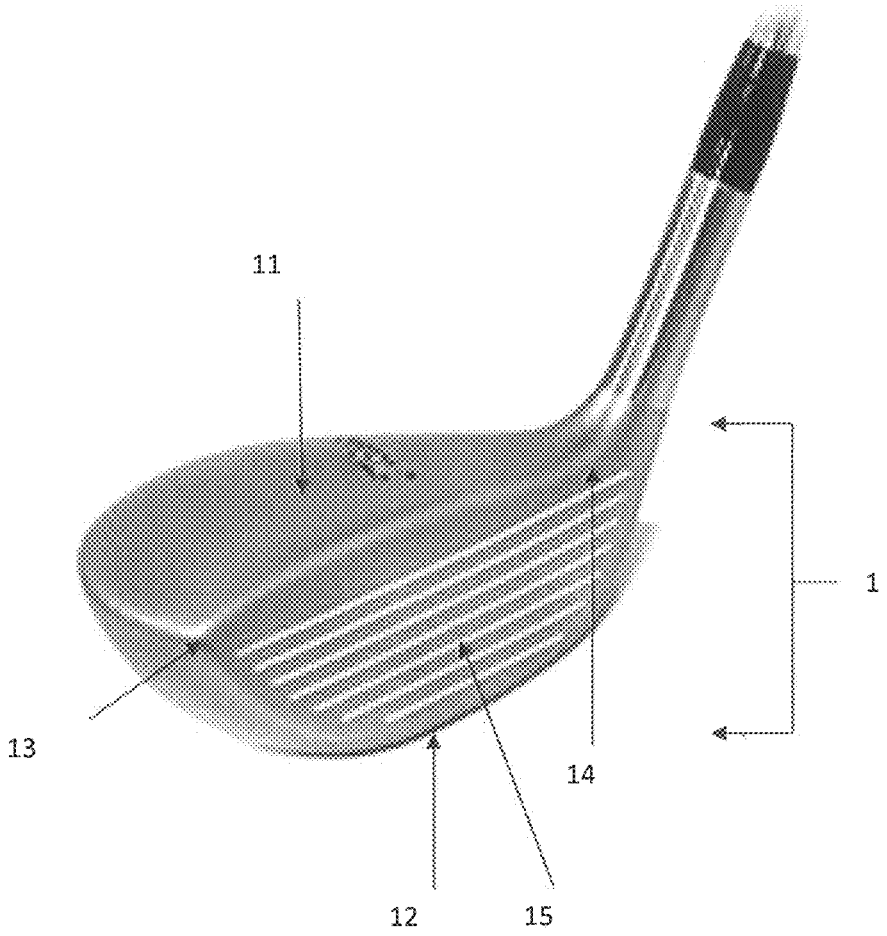
FIG. 1: shows a perspective view of a conventional golf club head.

Disclosed are non-putter golf clubs, e.g., drivers, fairway woods or metals, and rescue/utility clubs, and club heads having novel designs applied thereto or form a part thereof, that provide a means to accurately, consistently and repeatedly set the clubface at address. The designs described herein provide visual reference guides that allow golfers to recognize and adjust the face angle of the club to suit their needs (align, aim, straighten or shape their shot) and the requirements of the desired shot (fade, draw, straight, etc.). In an embodiment, "irons" which have no crowns to accommodate inventive designs described herein are excluded from the present invention.

The designs according to the present invention provide visual reference guides which at address enhance a golfer's ability to recognize the proper clubface alignment suitable for a specific desired shot-. This invention will be better understood by reference to figures which follow, but those skilled in the art will readily appreciate that the figures are only illustrative of the invention as described more fully in the claims. The designs can comprise two-dimensional elements. Advantageously the design consists of two-dimensional elements.

These visual reference guides include lines and sectors of a circle having corresponding longitudinal bisecting central lines, which sector preferably has a minimum span of 9° and a maximum span of 36°. These sectors can be further divided into subsections, which preferably have a 3° span. Colors are preferably selected so as to allow the user to easily differentiate between the incremental changes of the subsections.

By changing the clubface angle at impact, the trajectory of the ball flight will change. By knowing that each of the visual reference guides represents an incremental change in the clubface angle, users will be able to visually see where the clubface is directed and know that both the direction and the shape of the shot will change.

The designs as described therein may be applied to the crown of the golf club via various known means in the art. For example, the designs may be applied as an applique or sticker, attached via an adhesive, etched into the club head during manufacture, painted on, or applied as a mold fitting over the club head. Permanent, removable and reusable designs are all envisioned to be within the scope of the present invention.

The invention is described herein with reference to right-handed clubs. However, left-handed applications are envisioned to be within the scope of the present claims. For left-handed applications, components are horizontally reversed.

Terms

As used herein, and unless stated otherwise, each of the following terms shall have the definition set forth below.

As used herein, a "non-putter golf club" refers to any golf club which is not specifically designed for use in putting. Examples of a non-putter golf club include a driver, a fairway wood or metal, and a rescue/utility club.

As used herein, the term "line" is not limited to a continuous line having the same width throughout. Rather, "line" as used herein may be dashed or continuous, and may vary in thickness along the length of the line such that it more closely resembles a wedge, a triangle, or a sector of a circle. Where the "line" is represented by shapes such as a wedge, a triangle or a sector, either a longitudinal bisecting central line of said figure or a side line of said figure should adhere to the geometric arrangement of various "lines" as described herein. Further, a "line" as used herein includes designs such as a group of dots, stars, targets, or other markings, arranged in such a manner that a golfer viewing the design at address (from above) can readily perceive a distinct straight line defined by said markings.

As used herein, "entirely straight" when referring to a line of designs as described herein means that the line is not bent or curved along its entire length.

As used herein, "about" in the context of a numerical value or range means±10% of the numerical value or range recited or claimed.

As used herein, "address" refers to the position of the golfer being ready to play a stroke. That is, the golfer is standing over the golf ball with his club grounded (the sole of the club is touching the turf), in position to start his swing.

As used herein, "aiming" refers to the act of aligning the clubface to the target.

As used herein, "alignment" refers to the position of the golfer's body in relation to the initial target. More specifically, alignment refers to the direction that the body and club are "line up" in the address position.

As used herein, "setup" refers to the process of addressing the ball, so that the club and body are properly aimed and aligned. In another word, "setup" refers to the position that the player assumes when preparing to make a stroke.

As used herein, "clubface" refers to the striking surface, or the lofted part of the club head that (ideally) makes contact with the ball. A "closed clubface" or alternatively a "shut clubface" or a "closed stance", can refer to the alignment of the body/stance or clubface. For a right-handed player the stance would be closed if the body was aligned to the right of the target and a closed clubface would be aimed to the left of the target. The closed clubface position is formed when the toe of the club is closer to the ball than the heel, either at address or impact, which causes the clubface to point to the left of the target line. On the other hand, an "open clubface" refers to when, either at address or during the swing, the heel of the club head is leading the toe, causing the clubface to point to the side of the target.

As used herein, "intended line of flight" refers to the direction a player plans his ball to begin travel after impact, while "line of flight" refers to the actual path of the ball. Further "target line" refers to an imaginary (often visualized) line drawn behind and through the ball to the point a player is aiming. If the player is planning to curve the ball, this point is the initial, not ultimate, target. Yet further, "trajectory" refers to the height and angle the ball travels when struck.

As discussed above, designs described herein provide visual reference guides that allow golfers to recognize and adjust the face angle of the club to suit their needs (align, aim, straighten or shape their shot) and the requirements of the shot (fade, draw, hook, straight, etc.). As used herein "draw" refers to a shot that flies slightly from right to left for right handed players; "fade" refers to a shot that flies slightly from left to right and "hook" refers to a shot that curves sharply from right to left for right-handed players. Further as used herein, "slice" refers to a ball that curves from left to right to a greater degree than a "fade".

Finally, as used herein, the term "square" is used in a manner consistent with its plain meaning, as used in connection with golf. The term means at a right angle/perpendicular to, and can be used to describe a stance or the clubface.

Figure 2A:
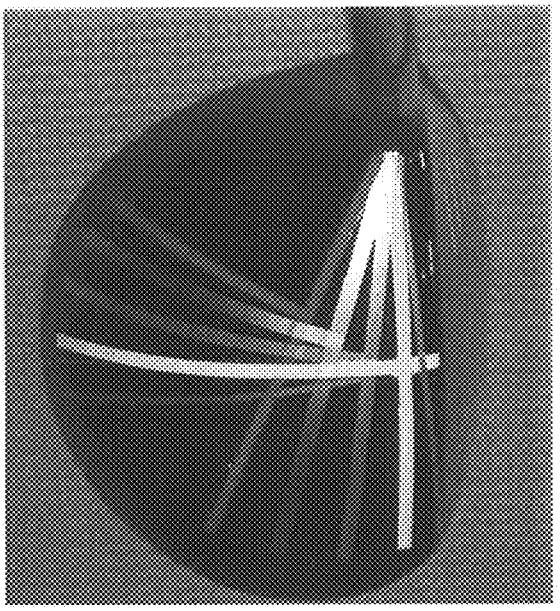
FIG. 2*a*: shows a top-side view of a design in accordance with an embodiment of the present invention.
Figure 2B:
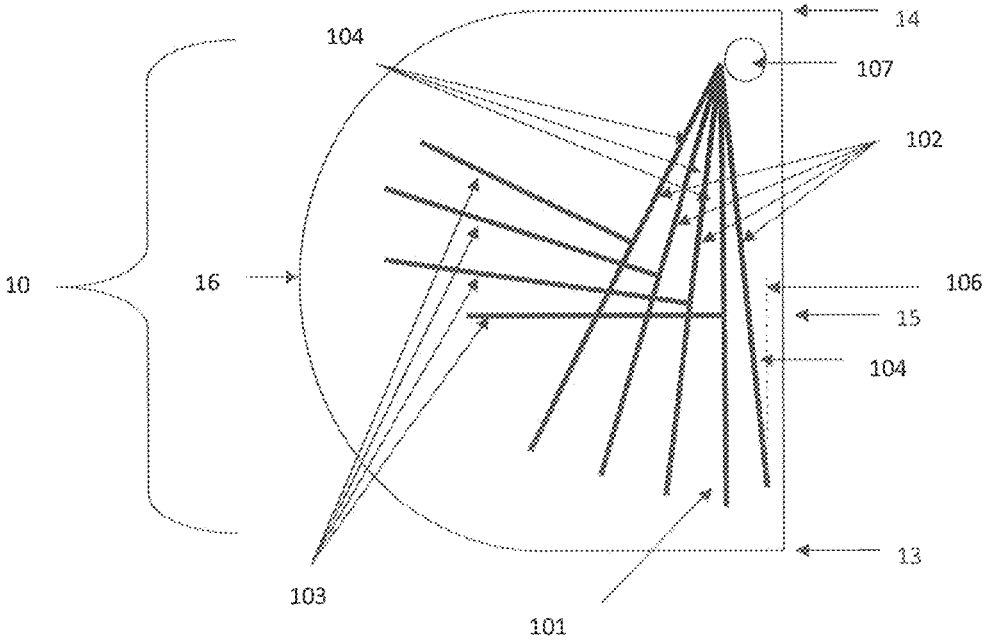
FIG. 2*b*: shows the black-and-white line drawing corresponding to the embodiment of FIG. 2*a*.

With reference to FIG. 1 and FIG. 2*b*, an embodiment of the disclosed golf club head (1) comprises a crown (11) and a sole (12) located opposite the crown, a heel end (13) and a toe end (14) located opposite the heel end, a striking surface (15), and a design (10) applied to the crown, which design comprises a vertical line (101) parallel to the striking surface (also referred to herein as the "Faceline"), and a first set of diagonal lines (102) consisting of one or more entirely straight lines configured such that: none of the lines of the first set of diagonal lines is parallel or perpendicular to the vertical line, no two lines of the first set of diagonal lines are parallel or perpendicular to each other, each line of the first set of diagonal lines forms an acute angle (104) with a plane parallel to the striking surface (106), which plane passes through the endpoint of said line located nearer to the striking surface, and the lines of the first set of diagonal lines converge towards the heel end (the distance between the lines decrease moving towards the heel end), and diverge towards the toe end (the distance between the lines increase moving towards the toe end).

As will be appreciated by a person skilled in the art, each line in the first set of diagonal lines (104) has two endpoints. Each said endpoint has a single plane which simultaneously passes through it and is parallel to the striking surface. By specifying that the plane passes through the endpoint located nearer to the striking surface, a single, definitive plane is defined with respect to each line of the first set of diagonal lines (104).

Optionally but preferably, the design (10) comprises a second set of diagonal lines (103), said second set of diagonal lines consists of one or more entirely straight lines configured such that each line of the second set of diagonal lines is perpendicular either to the vertical line (101) or to a line of the first set of diagonal lines (102). In an embodiment, the second set of diagonal lines comprises at least one line perpendicular to the vertical line (101). The line perpendicular to the vertical line (101) may also be referred to herein as the "Baseline". In a further embodiment, each of the vertical line (101) and each line of the first set of diagonal lines (102) has at most one corresponding perpendicular line in the second set of diagonal lines (103).

In a further embodiment of the invention, the design as describes herein consists essentially of, or consist of, elements as described in this application.

This disclosure further provides for a golf club comprising the golf club head as described herein.

This disclosure further provides for a kit comprising a plurality of lines for application to the head of a non-putter golf club, and instructions for applying said plurality of lines to the crown for obtaining the golf club head as described herein. Further, this disclosure provides for methods of using inventive designs described herein to enhance a player's golf game in manners discussed herein.

The Vertical Line (101)

The vertical line (101) is parallel to the striking surface, and preferably radiates from the center of the cylinder of the club shaft towards the toe end of the club.

Figure 3:
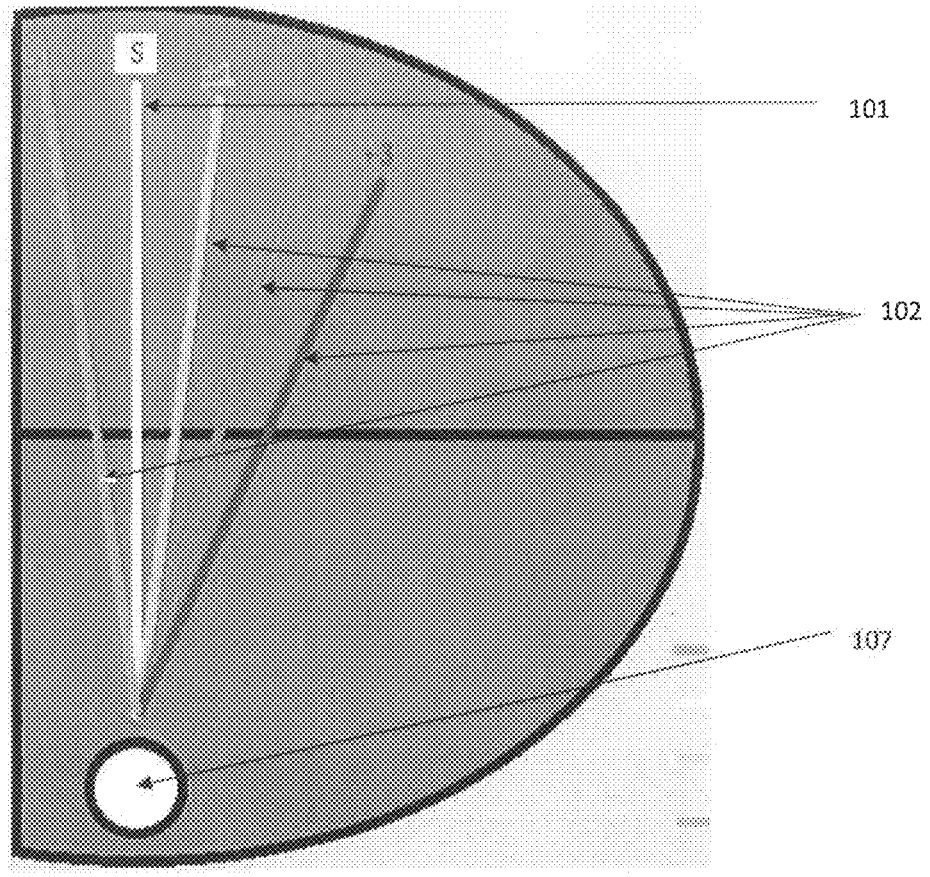
FIG. 3: shows a top-side view of a design in accordance with an embodiment of the present invention.
Figure 4:
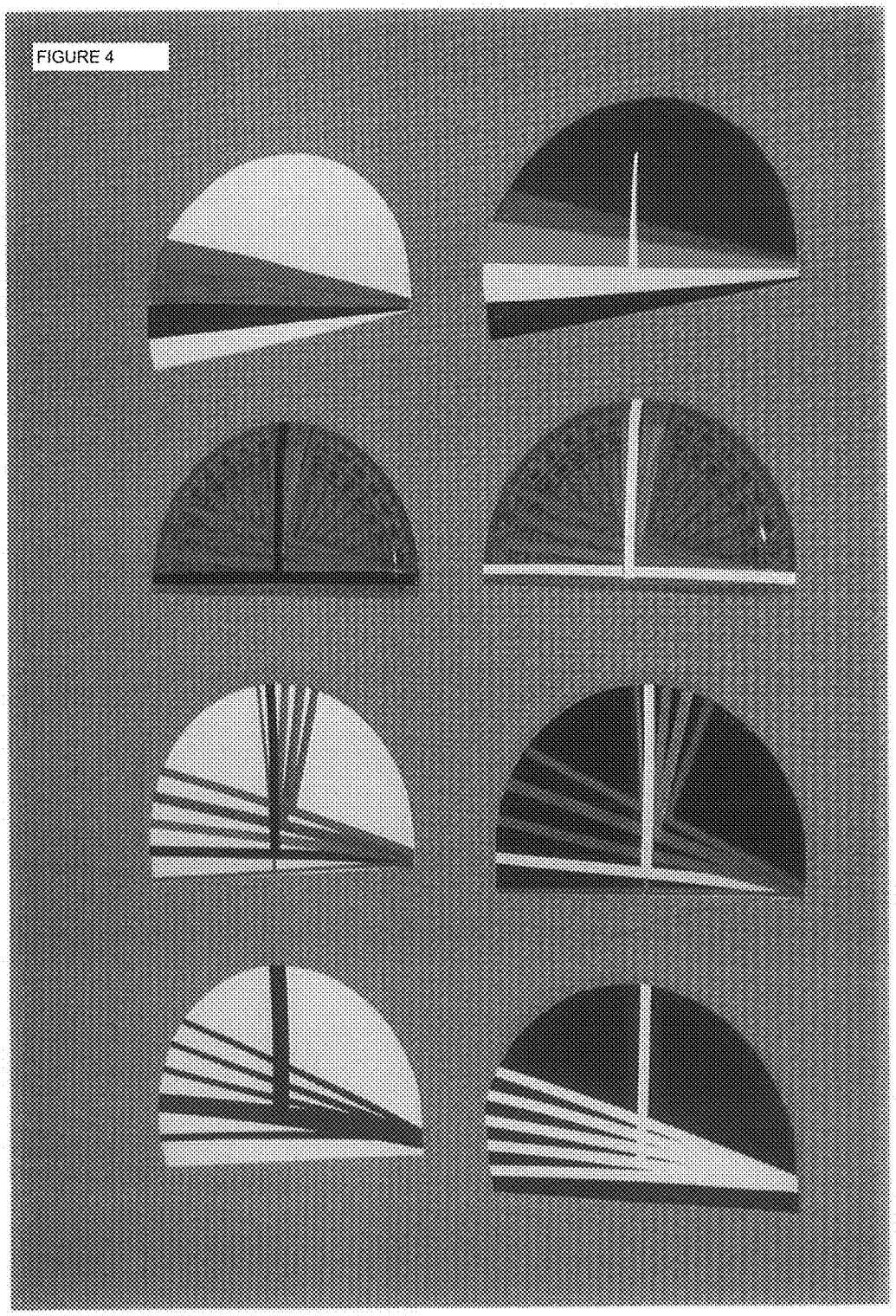
FIG. 4: shows angles of designs in accordance with additional embodiments of the present invention.
Figure 5:
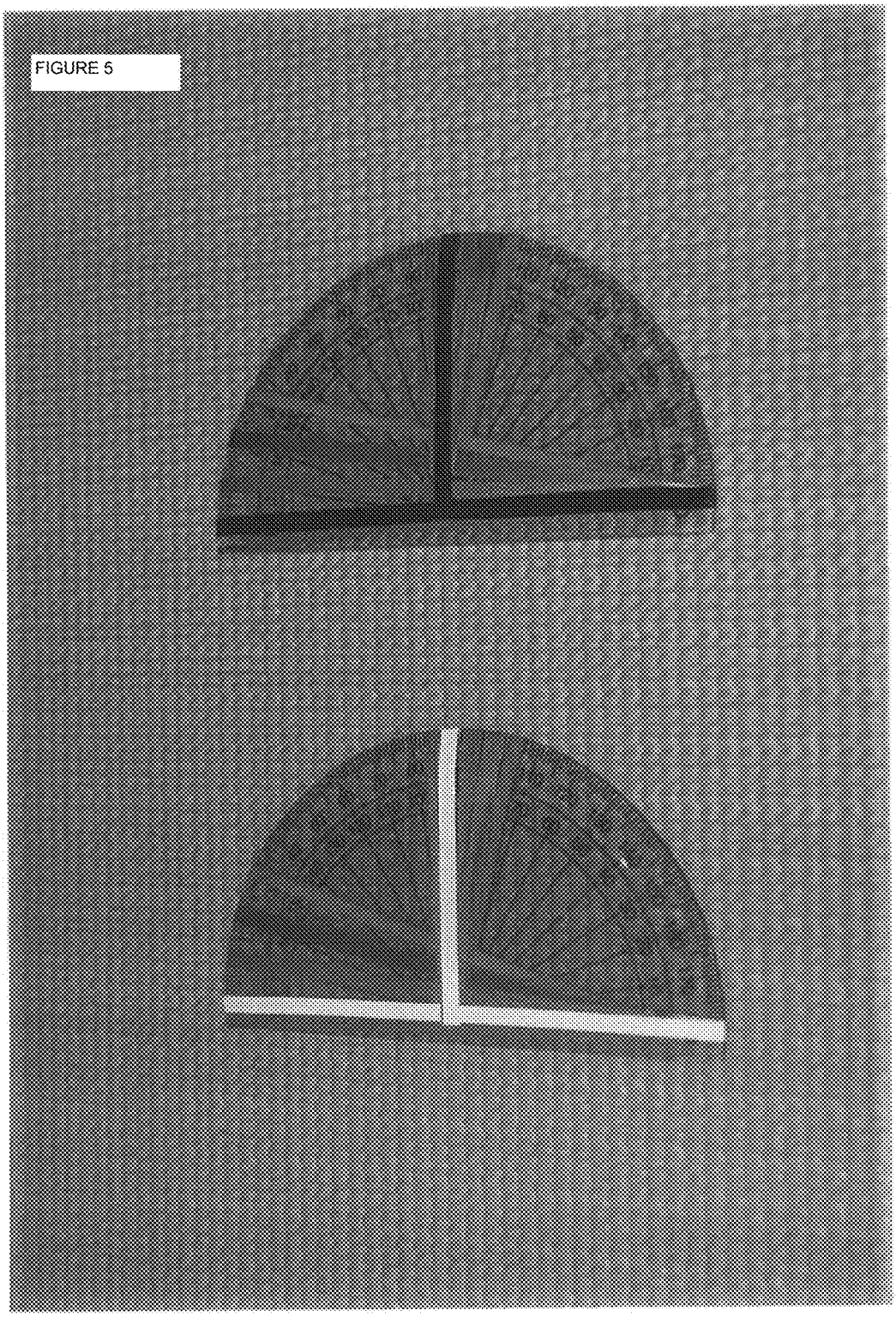
FIG. 5: shows angles of designs in accordance with additional embodiments of the present invention.
Figure 6:
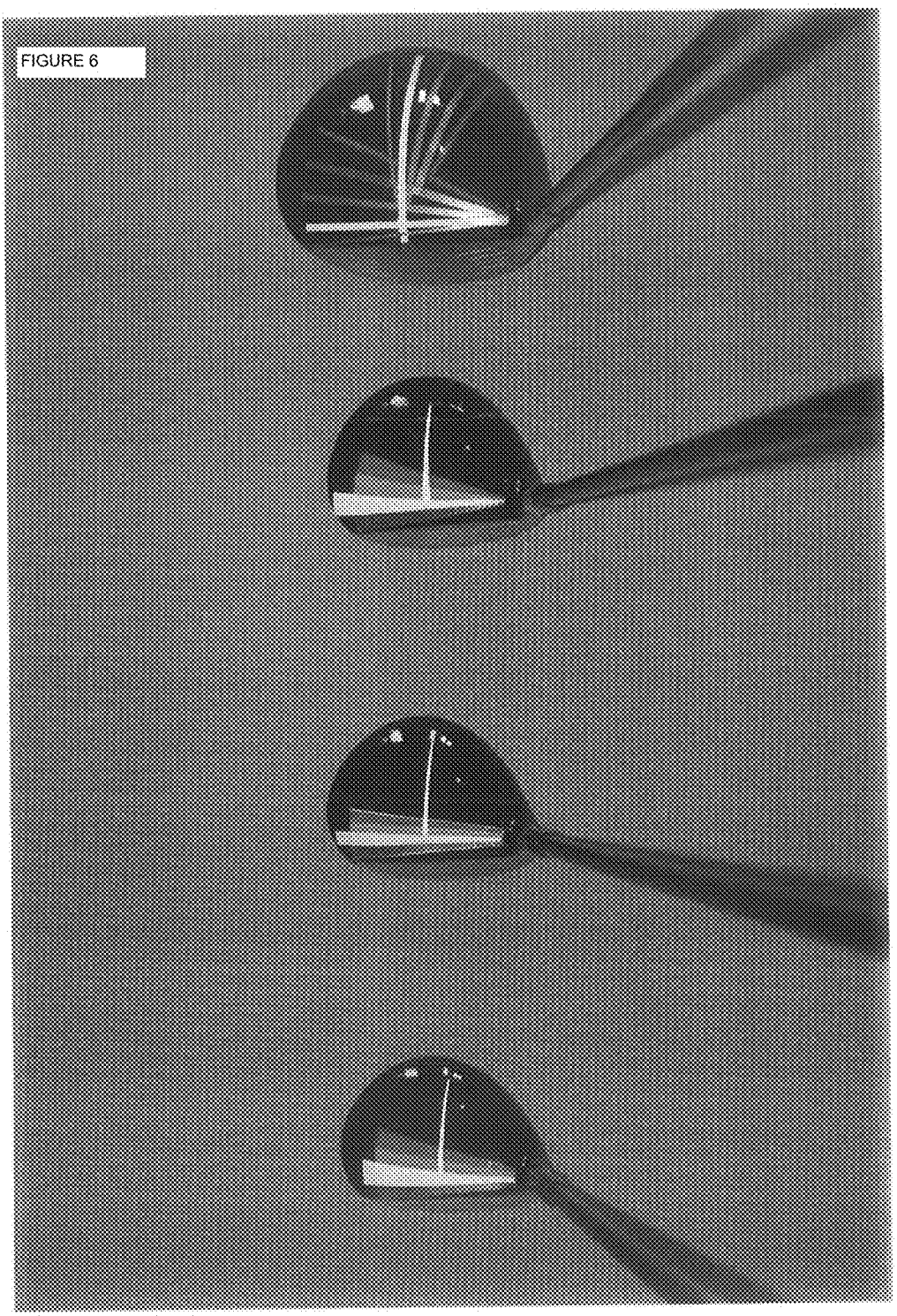
FIG. 6: shows top-side views of golf clubs having designs in accordance with embodiments of the present invention.
Figure 7:
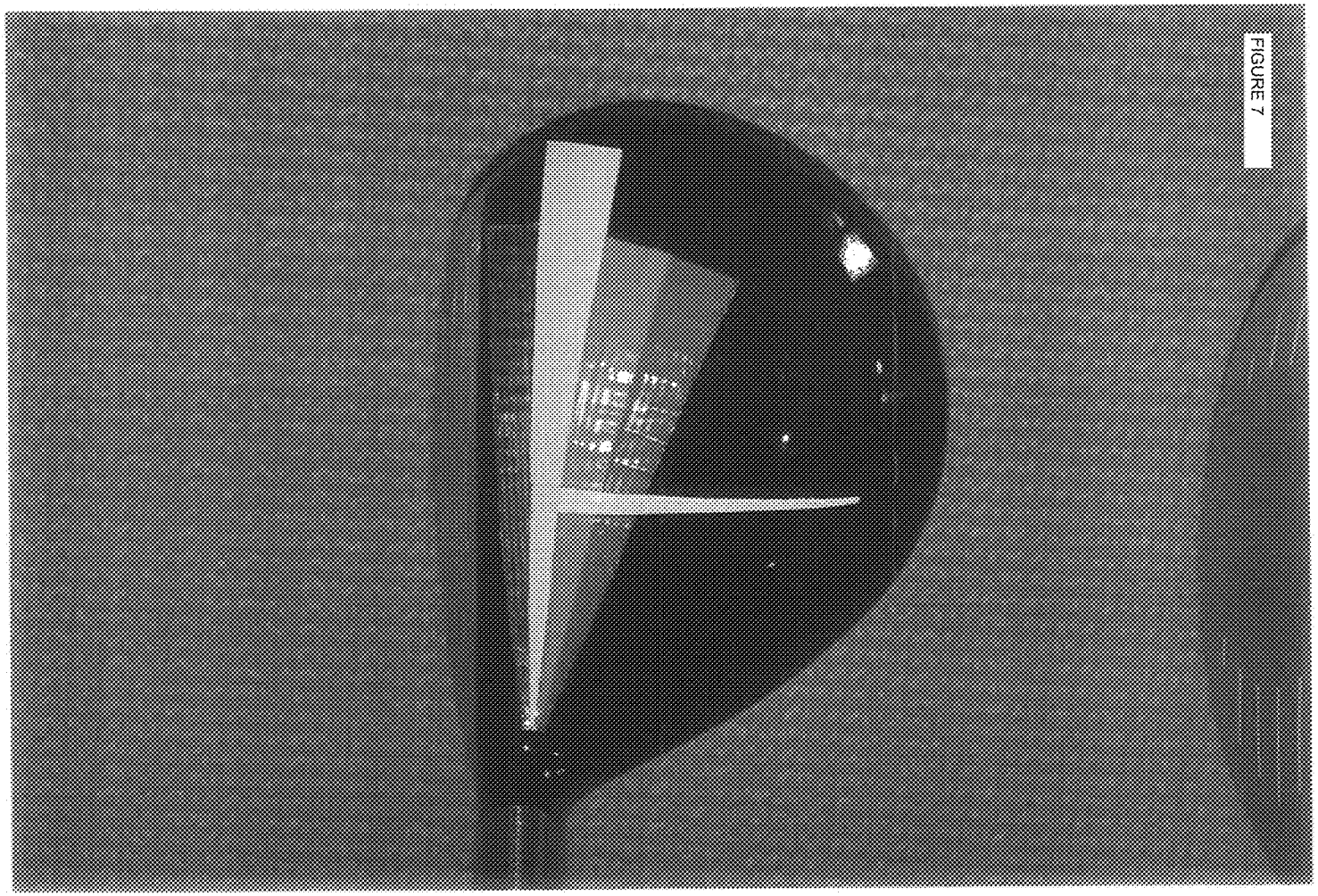
FIG. 7: shows a top-side view of a golf club having a design in accordance with an embodiment of the present invention.
Figure 8:
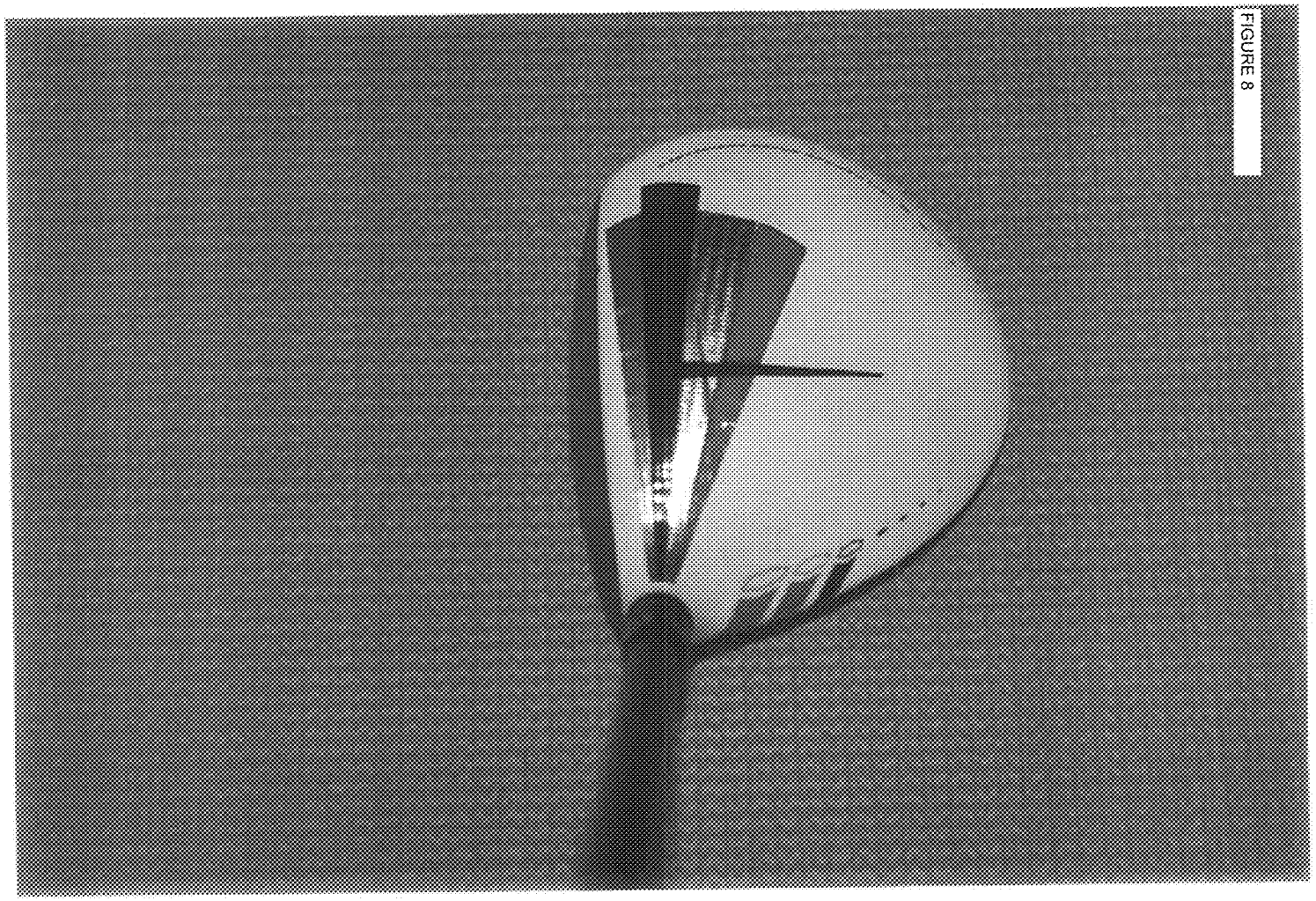
FIG. 8: shows a top-side view of a golf club having a design in accordance with an embodiment of the present invention.
Figure 9:
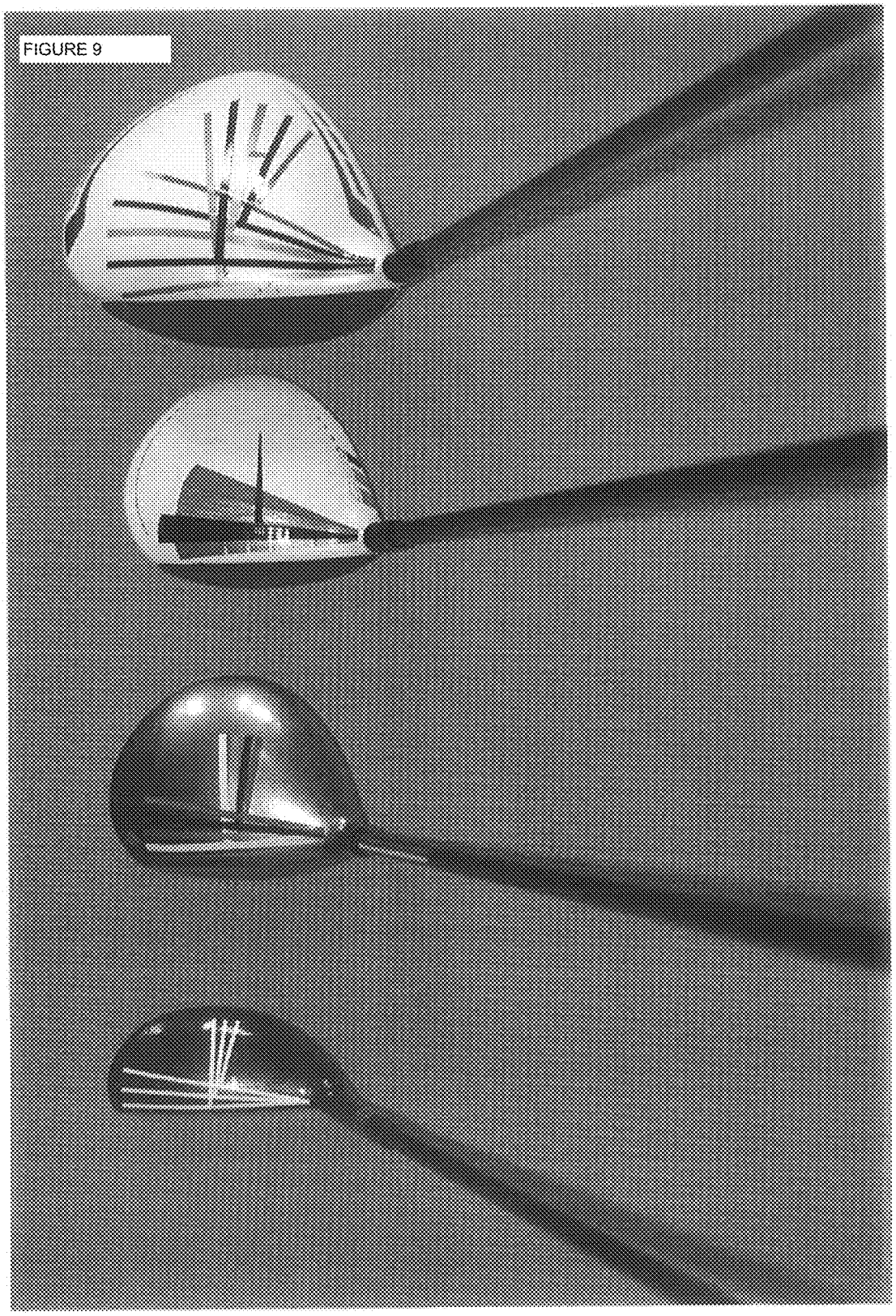
FIG. 9: shows top-side views of golf clubs having designs in accordance with embodiments of the present invention.

As shown in FIG. 3, the vertical line indicates to the golfer that the alignment of the clubface angle is "square". For ease of locating the "square" alignment, the vertical line can have a different visual appearance, e.g., be of a different thickness, length and/or color, as compared to the other lines of the design. Advantageously, only one vertical line is part of the design.

The vertical line can extend the entire length of the crown or only a portion thereof. In order of increasing preference, the length of the vertical line is 50%, more than 50%, more than 60%, more than 70%, more than 80% or more than 90% of the length of the crown measured from the heel end to the toe end.

The First Set of Diagonal Lines (102)

As shown in FIG. 3, the lines of the first set of diagonal lines (102) indicates to the golfer that alignment of the clubface is other than "square" which may facilitate hitting various types of more advanced golf shots. With reference to FIG. 3, the diagonal lines can correspond to alignment appropriate for the "fade", "soft draw", "full draw", and "hook" shots. For the fade shot, the acute angle formed by the diagonal line and a plane which is parallel to the striking surface and passes through the endpoint of the line located nearer to the striking surface, is open to the heel end. For the soft draw, full draw, and hook shots, such acute angle is open to the toe end.

Advantageously, the first set of diagonal lines can consist of one, two, three, or four lines. In another embodiment, the first set of diagonal lines can comprise, preferably consist of more than four lines. For ease of locating different alignments for different shots, the lines can have different visual appearances, e.g., be of a different thickness and/or color as compare to each other.

The lines of the first set of diagonal lines can extend the entire length of the crown or only a portion thereof. In order of increasing preference, the length of these lines are individually 50%, more than 50%, more than 60%, more than 70%, more than 80% or more than 90% of the length of the diagonal of the crown measured from the heel end to the toe end. Individual lines within the First Set of Diagonal Lines may be of the same or different lengths. In an embodiment, the First Set of Diagonal Lines comprises lines of at least two, three, four or five different lengths.

In one embodiment of the present invention, the vertical line and all lines of the first set of diagonal lines intersect near or at a single point. In another embodiment of the present invention, the vertical line and all lines of the first set of diagonal lines intersect at a single point, viz, extend outwardly radially from a single point. In another word, the lines fan out radially from a single point. In an embodiment, said single point is near the hosel (107) or an equivalent element for adjoining the golf head to the club shaft. As used herein, two elements being "near" one another means that the distance between the two elements is, in order of increasing preference, less than 50%, less than 30%, less than 15%, less than 10% or less than 5% of the length of the diagonal of the crown measured from the heel end to the toe end.

The Second Set of Diagonal Lines (103)

The lines of the second set of diagonal lines (103) are each perpendicular to either the vertical line, and/or a line of the first set of diagonal lines, and indicate to the golfer the anticipated flight path of the ball associated with a particular alignment of the clubface.

The lines of the second set of diagonal lines can extend the entire length of the crown or only a portion thereof. In order of increasing preference, the length of these lines are individually 50%, more than 50%, more than 60%, more than 70%, more than 80% or more than 90% of the length of the width of the crown measured from the striking surface to the rear end of the club (16) which is located opposite the striking surface (15). Individual lines within the Second Set of Diagonal Lines may be of the same or different lengths. In an embodiment, the Second Set of Diagonal Lines comprises lines of at least two, three, four or five different lengths.

In an embodiment, the design is an "instructional version" which includes each of the vertical line (101), the first set of diagonal lines (102) and the second set of diagonal lines (103) to show clubface and foot alignment, and the intended flight path of the golf ball. In another embodiment, the design uses only lines to show the clubface alignment, i.e., the vertical line (101) and the first set of diagonal lines (102), and is intended for use by a more advanced player who understands the required foot position and the intended flight path.

The Baseline (103*a*)

In an embodiment of the present invention, the second set of diagonal lines (103) comprises a line which is perpendicular to the vertical line (101), which line is designated the Baseline (103*a*). This line can be represented by a sector of a circle, a wedge or a triangle, whose longitudinal centerline bisecting the sector is perpendicular to the vertical line (101). The Baseline preferably runs from the center of the top of the face of the club to the most negative radial line of the main body (sector), and continues again from the most positive radial line to the end of the crown. The Baseline point directly to and away from the center of the clubface.

Additional Embodiments of the Present Invention

Multiple versions and color combinations are contemplated in connection with the disclosed invention. For instance, any of the vertical line (101), first set of diagonal lines (102) and second set of diagonal lines (103) may be of the same or different colors, length, design and/or thickness. They may individually be dashed or continuous.

In an embodiment, each of the lines of the first set of diagonal lines (102) may be of a different color, which may further be a different color from that of the vertical line (101). In a separate embodiment, each of the lines of the second set of diagonal lines (103) may be of a different color, which may further be a different color from that of the vertical line (101) and/or lines of the first set of diagonal lines (102). In yet another embodiment, each line of the second set of diagonal lines (103) has the same color as the vertical line (101) and/or the line of the first set of diagonal lines (102) to which they are perpendicular. In further embodiments, any combination of the vertical line (101), the first set of diagonal lines (102), and the second set of diagonal lines (103), including the Baseline (103*a*), may have color or colors which is/are visually distinct from a color of the background (on the crown of the club).

In an embodiment, the vertical line (101) and the Faceline (103*a*) are more visually pronounced than all other lines included in the design, via careful selection of color, size, thickness, etc. For example, the vertical line may be of a color which is different from all the other lines of the design. To set it apart, the vertical line may also be the longest line or thickest line of all the lines of the design.

The lines of the design according to the present invention may have different thicknesses between their ends. One or more of the lines may have thicknesses which vary along its length. For instance, the width of any line may increase or decrease between its ends so that the "line" resembles an elongated trapezoid, wedge or a triangle. One or more of the lines may have constant thicknesses so that visually the "line" a rectangle.

The length of lines will depend on the golf club to which the design will be applied. The length preferably ranges from 2" to 5". A length of 4 inches will fit most drivers. A length of 3 inches will fit most fairway woods.

The acute angles of the designs as described herein are preferably 3° to 6°. The inventor has surprisingly found that designs having angles in the 3° to 6° range provides the optimal balance of two conflicting design requirements: (1) lines which are sufficiently wide to provide a strong visual presence, such that the line can be readily perceived by a golfer at address, who would be viewing the design from a distance away, and (2) lines narrow enough to ensure that consistency and repeatability of clubface alignment is not compromised. By any range disclosed herein, it is meant that all tenth and integer unit amounts within the range are specifically disclosed as part of the invention. Accordingly, the acute angle as described herein include but is not limited to 3°, 4°, 5° or 6°. Also it is possible to have different acute angles within a design. For example, individual lines within the First and/or Second Set of Diagonal Lines can have different thicknesses and/or be represented by sectors having different acute angles. In an embodiment, the First and/or Second Set of Diagonal Lines comprise lines of at least two, three, four or five different thicknesses. In another embodiment, the First and/or Second Set of Diagonal Lines comprise lines represented by sectors having at least two, three, four or five different acute angles.

In a further particular embodiment of the present invention, the design applied to the crown comprises, or consists of the vertical line (101) and the first set of diagonal lines (102). In another embodiment of the present invention, the design applied to the crown comprises or consists of the vertical line (101), the first set of diagonal lines (102) and the second set of diagonal lines (103)

Finally, the combination of any embodiment or feature mentioned herein with one or more of any of the other separately mentioned embodiments or features is contemplated to be within the scope of the instant invention. Any embodiment or feature mentioned herein with respect to the disclosed inventive golf club head and design is envisioned to be equally applicable to the golf club and the kit provided herein.

Example 1

Figure 11:
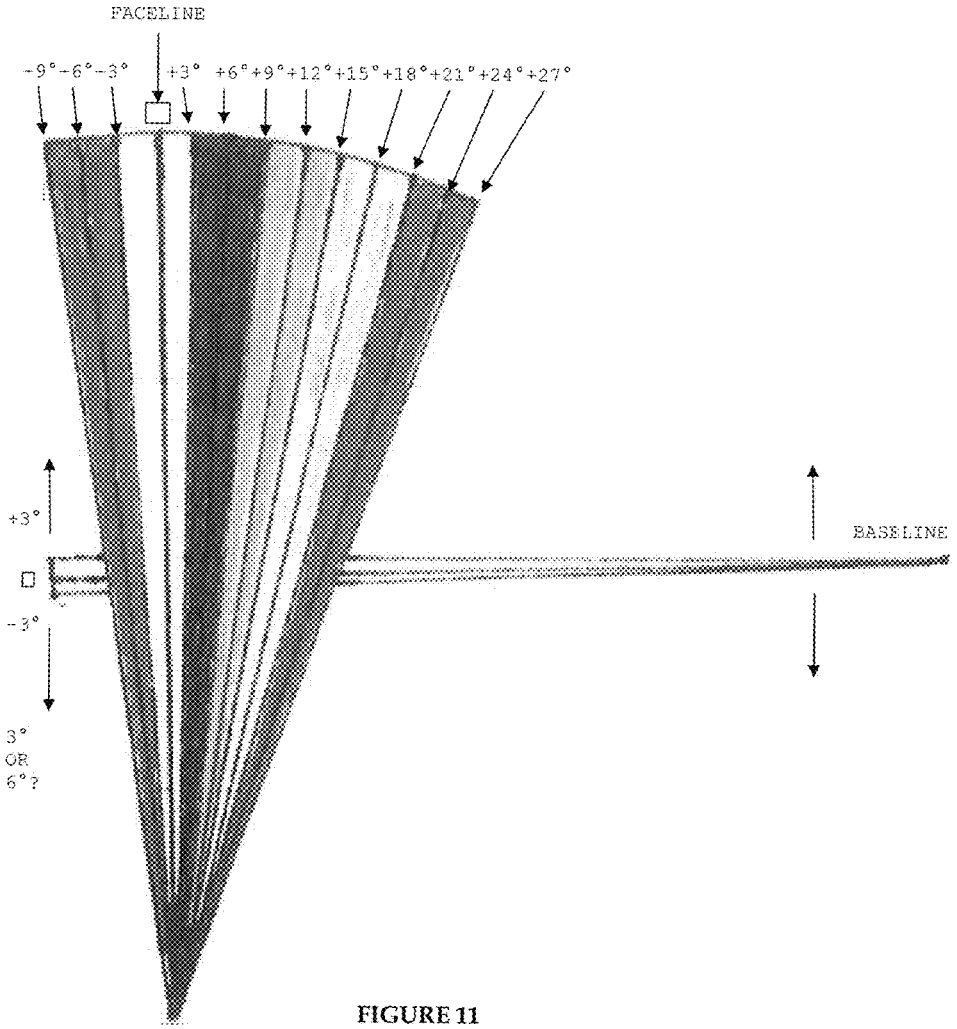
FIG. 11: shows angles of designs in accordance with an additional embodiment of the present invention.
Figure 12A:
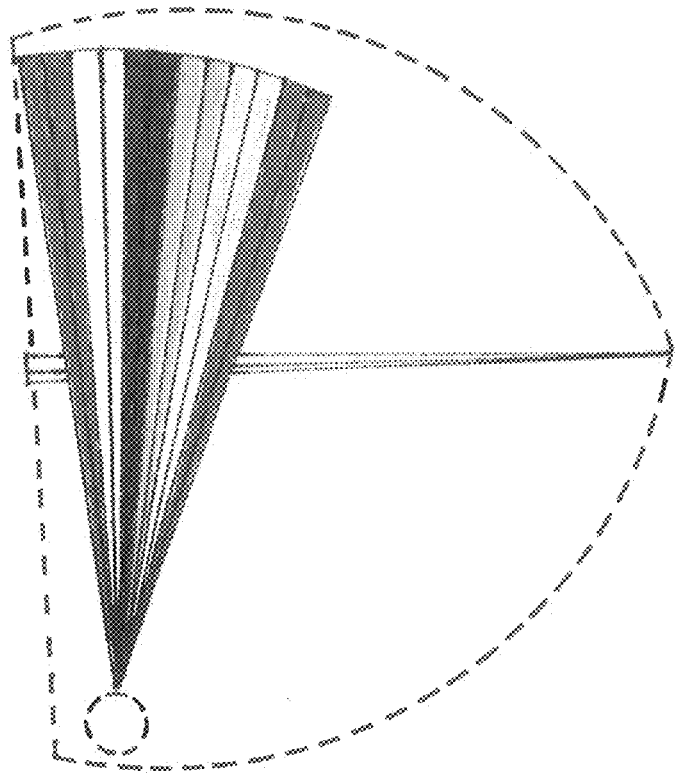
FIG. 12*a*: shows a top-side view of a golf club having a design in accordance with an embodiment of the present invention.
Figure 12B:
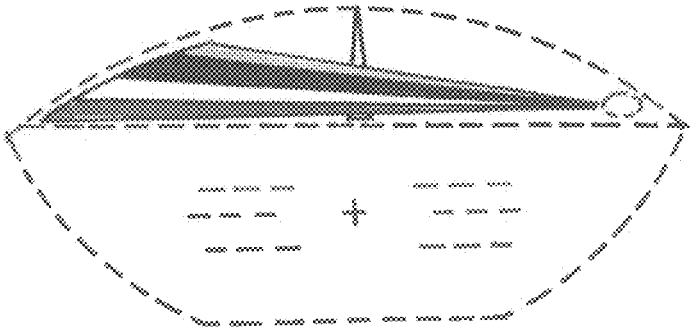
FIG. 12*b*: shows a front view of a golf club corresponding to the embodiment of FIG. 12*a*.
Figure 14A:
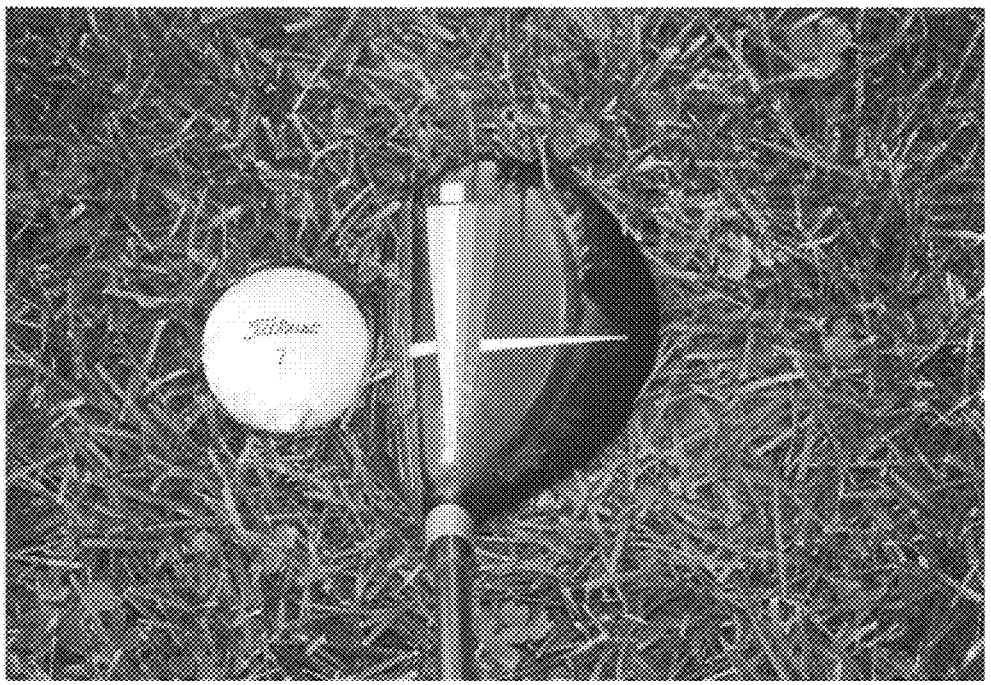
FIG. 14A: shows a top-side view of a driver having a design in accordance with an embodiment of the present invention, using 5 sectors of different colors, each having an acute angle of 6°.
Figure 14B:
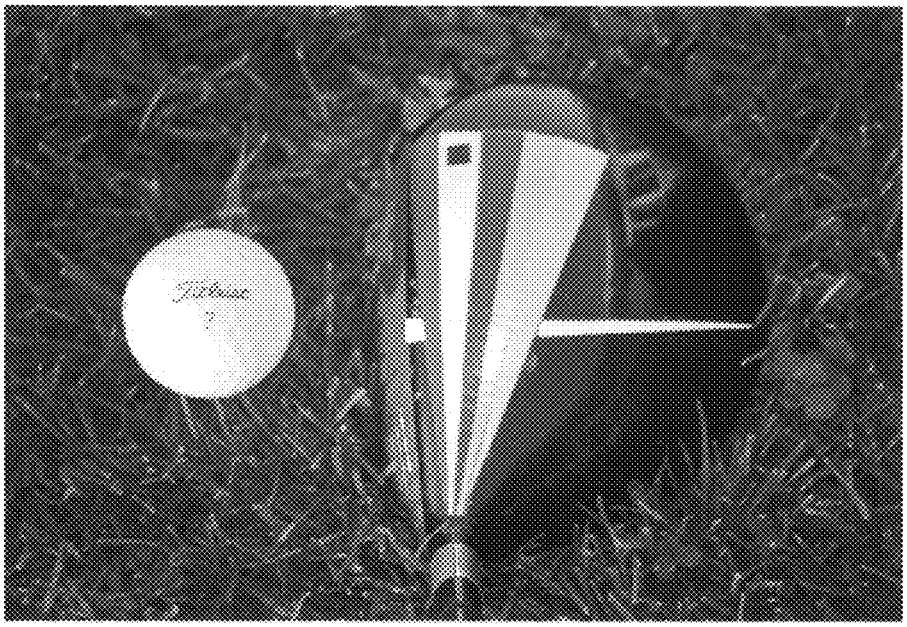
FIG. 14B: shows a top-side view of a fairway wood having a design in accordance with an embodiment of the present invention, using 4 sectors of different colors, each having an acute angle of 3°.
Figure 14C:
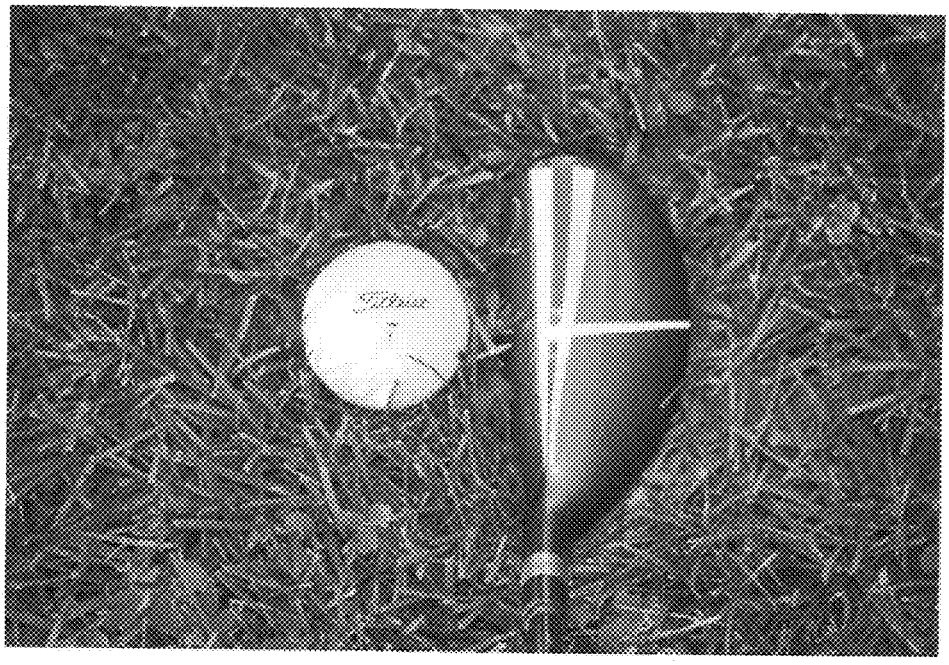
FIG. 14C: shows a top-side view of a rescue/utility club having a design in accordance with an embodiment of the present invention, using 3 sectors each having an acute angle of 3°, where two of the three sectors are of the same color (2 colors total).
Figure 14D:
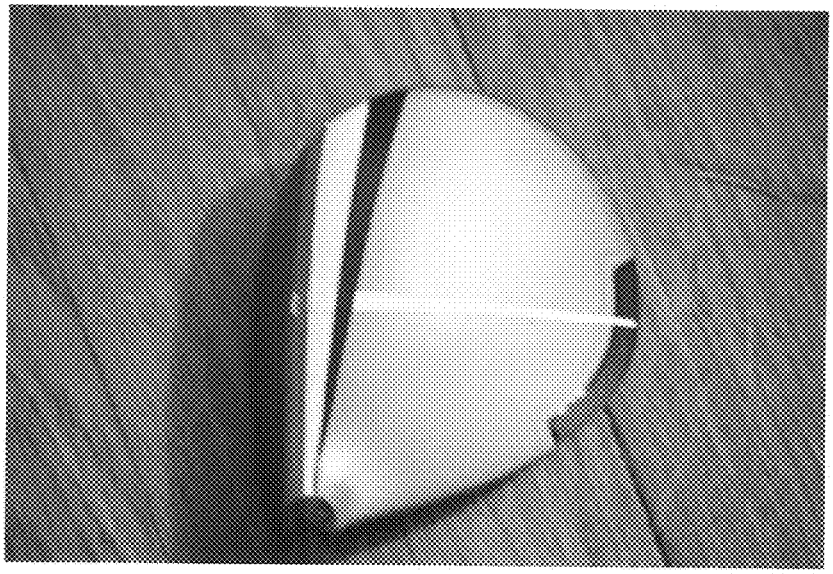
FIG. 14D: shows a top-side view of a driver having a design in accordance with an embodiment of the present invention, using 3 sectors each having different acute angle (one 3° red sector, one 6° white sector, and one 5° black sector).
Figure 14E:
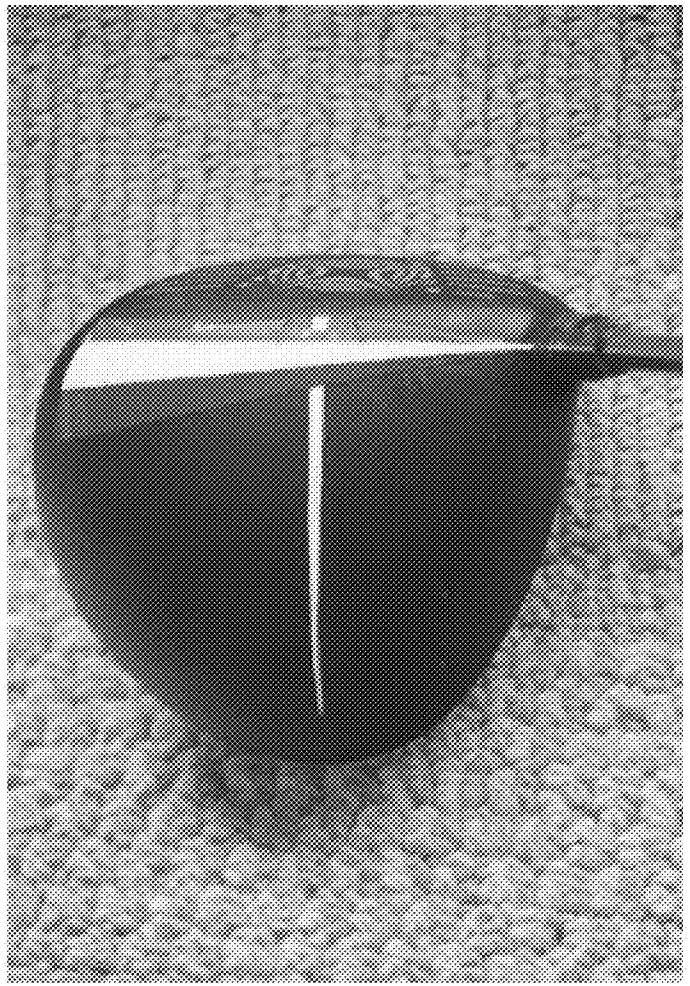
FIG. 14E: shows a top-side view of a driver having a design in accordance with an embodiment of the present invention, using 3 sectors having 2 different acute angles (one 3° red sector, one 6° white sector, and one 6° blue sector).
Figure 15:
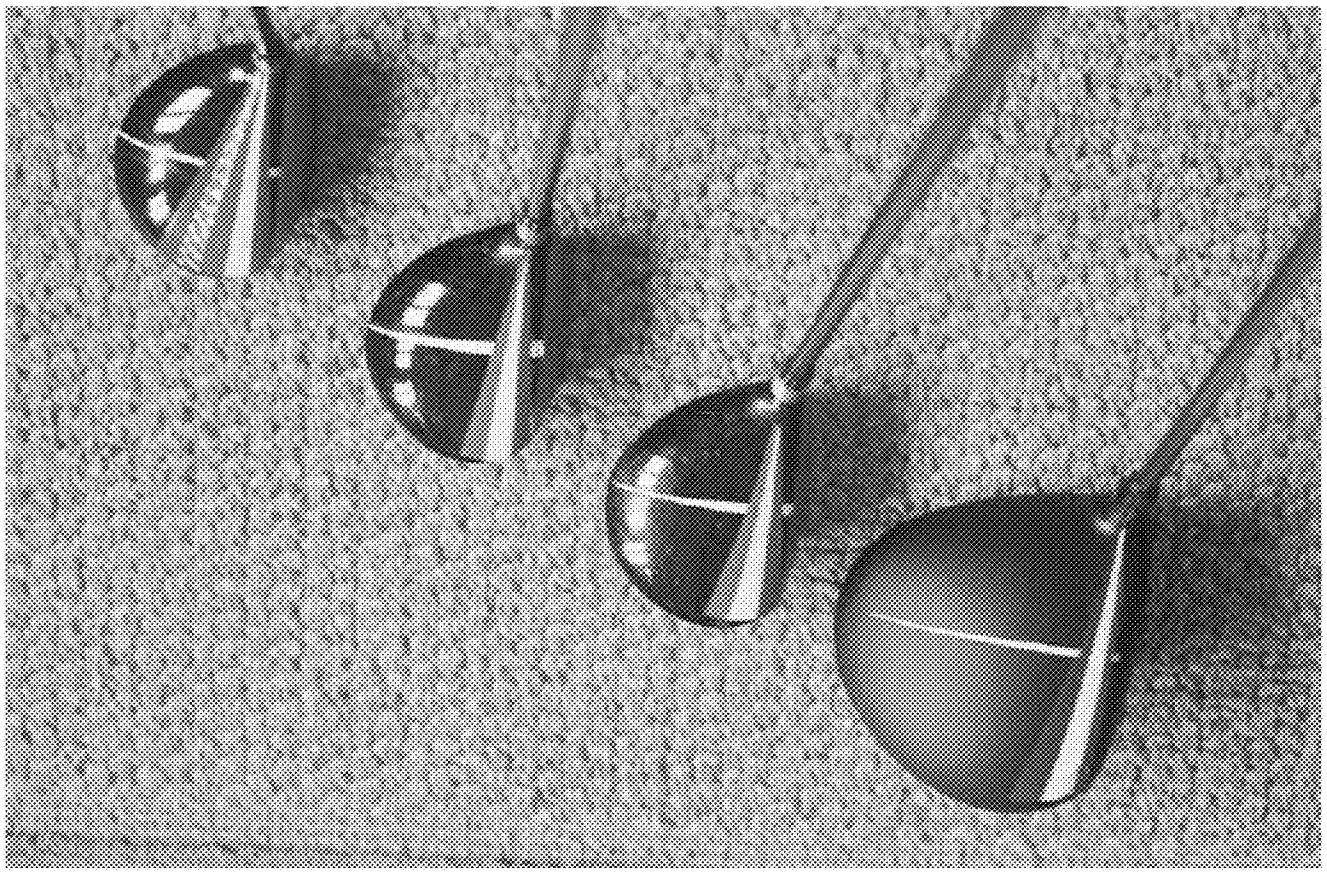
FIG. 15: shows top-side view of 4 clubs in accordance with embodiments of the present invention: Driver: 3 sectors (acute angles 3°, 6°, 6°); 3 Wood: 3 sectors (acute angles 6°, 6°, 6°); 5 Wood: 3 sectors (acute angles 6°, 6°, 6°); and 7 Wood: 5 sectors (acute angles 5°, 6°, 6°, 5°, 5°).
Figure 16:
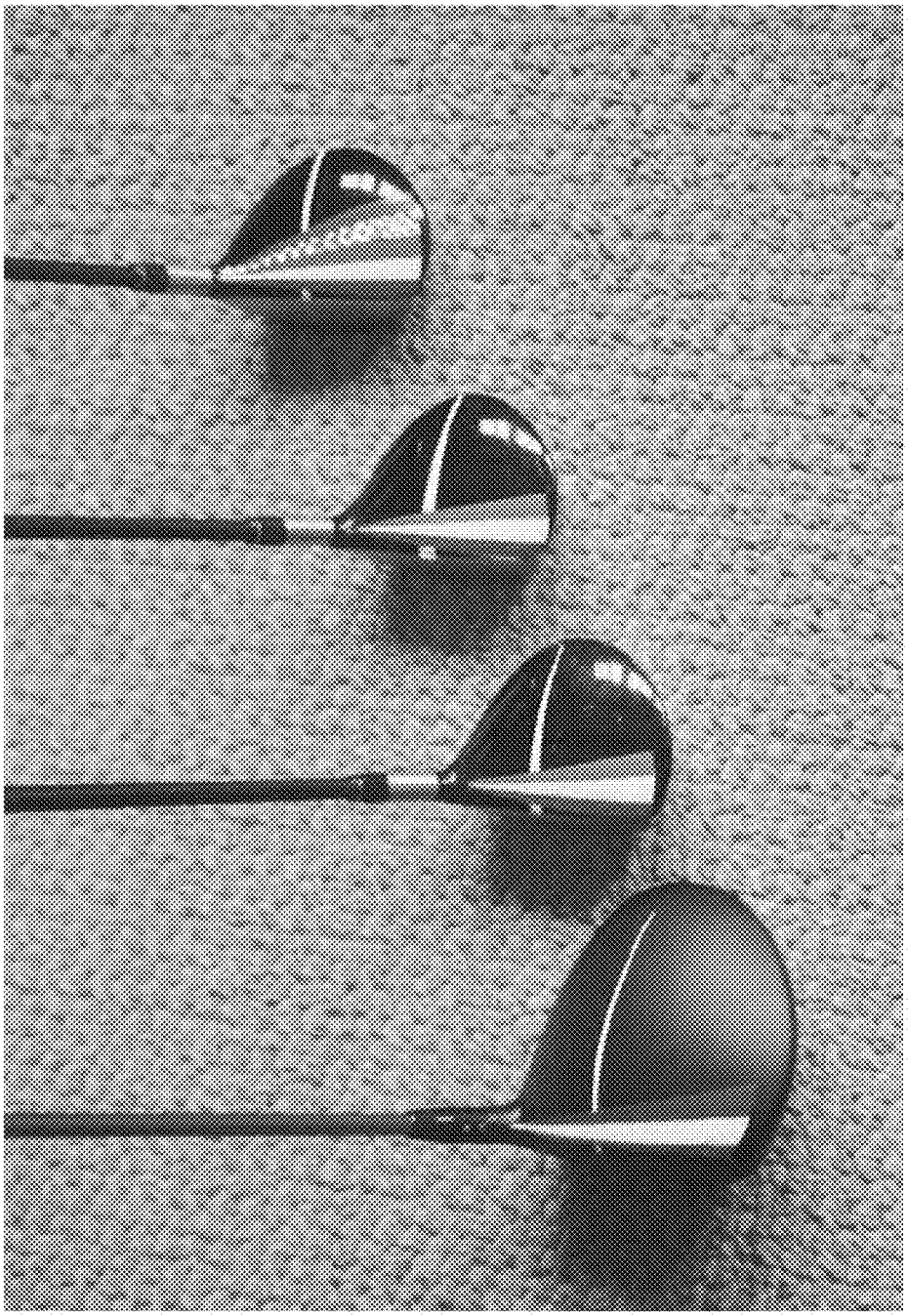
FIG. 16: shows top-side view of 4 clubs in accordance with embodiments of the present invention (Driver, 3 Wood, 5 Wood and 7 Wood).
Figure 17:
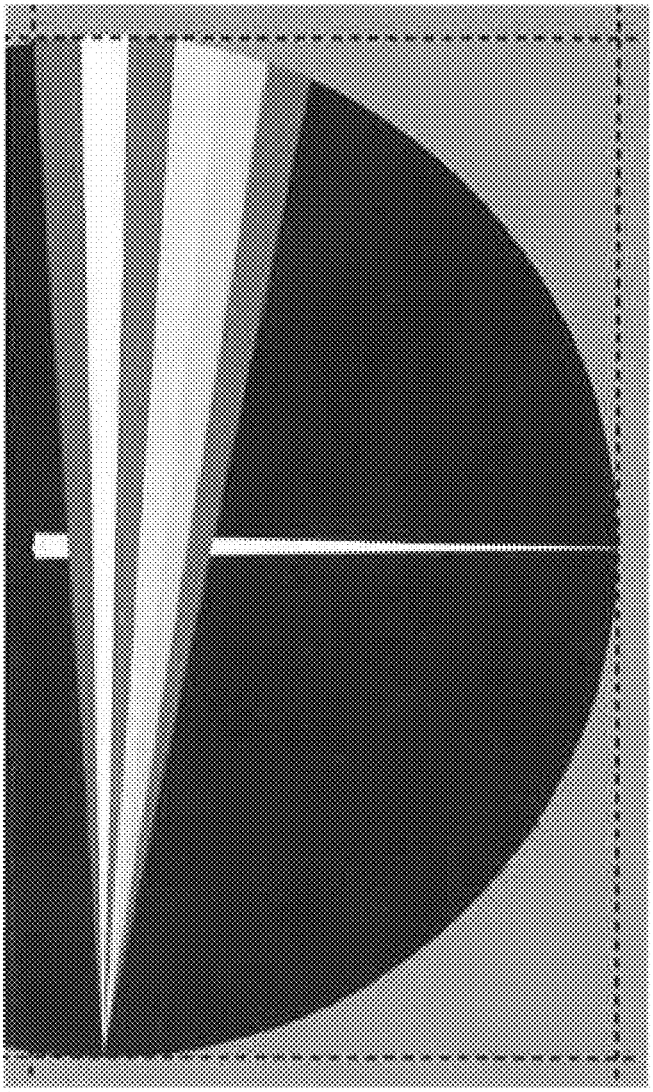
FIG. 17: shows a top-side view of a design according to an embodiment of the present invention, wherein the lines are represented by sectors which extend the entire length of the crown (goes from one edge to the opposite edge of the crown).

FIG. 11 shows a particularly preferred embodiment of the present invention. In FIG. 11, the vertical line and the first set of diagonal lines can come together to form a sector of a circle having, e.g, a 4 inch radius, with the sector having an angle formed by boundary at −9° and +27°. This sector is further divided into 3° increment subsectors (−6°, −3°, 0°, +3°, +6°, +9°, +12°, +15°, +18°, +21°, and +24°). The vertical line (101) is at 0°, and is more prominent than all other lines.

Example 2

Figure 10:
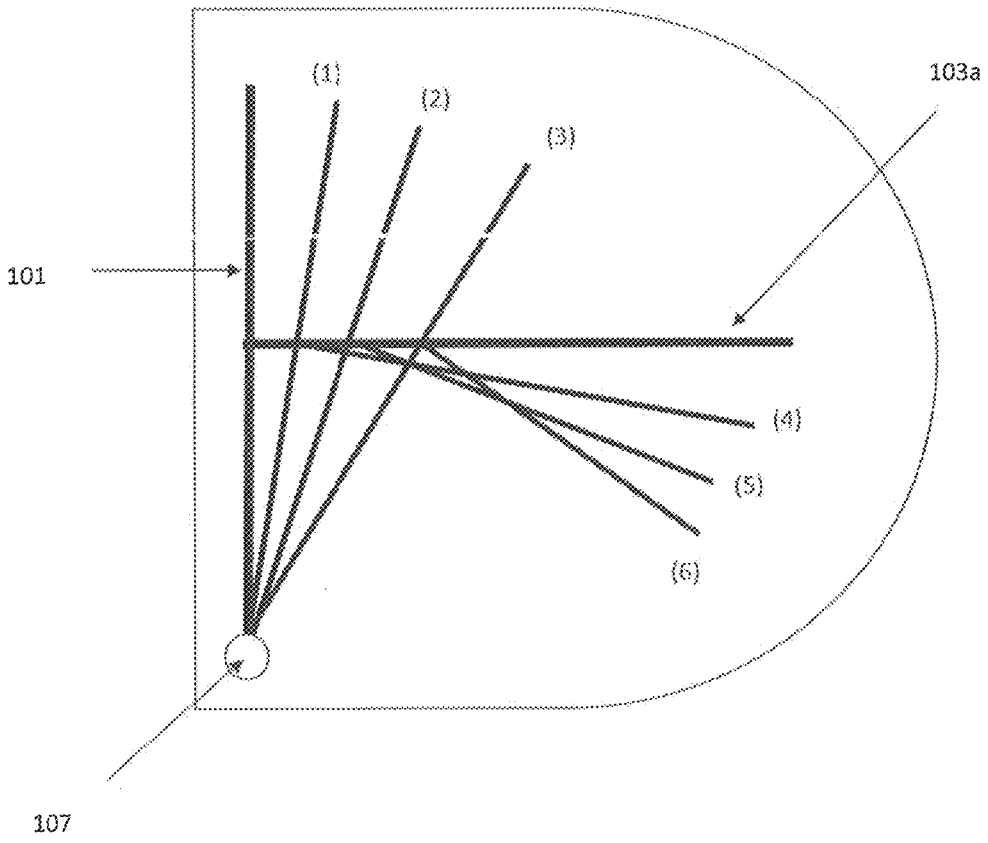
FIG. 10: shows a line drawing of a design in accordance with an additional embodiment of the present invention.

FIG. 10 shows an "instructional version" of the present invention which includes each of the vertical line (101), the first set of diagonal lines (102) and the second set of diagonal lines (103) to show clubface and foot alignment, and the intended flight path of the golf ball. In this embodiment, the second set of diagonal lines include a Baseline (103*a*), i.e., a line perpendicular to the vertical line (101).

The "instructional version" of the present invention can be utilized by a golfer as an alignment, aiming and shot shaping aid as follows:

Right Face

1. Set shoulders, hips and feet on a line parallel to the intended ball flight path to the target.
2. Decide which flight path shape is appropriate.
3. For a straight shot:
   a. Set clubface so the Faceline is perpendicular to the intended flight path and the Baseline is on the intended flight path.
   b. Situate both the body and the clubface square to the target.
   c. Make the best swing to return the clubface to square at the point of contact with the ball.
4. For a soft draw
   a. Set up square (straight shot stance and clubface).
   b. Align feet, hips and shoulders with line (4).
   c. Turn clubface so that line (1) is perpendicular to the feet, hips, and shoulder, and line (4) is horizontal (parallel to stance). Now line (4) is the is the line of flight the ball should start on, and the Baseline points to where the line of flight should end.
5. For a draw—repeat steps for soft draft, but use line (2) in place of line (1), and line (5) in place of line (4).
6. For a hook—repeat steps for soft draft, but use line (3) in place of line (1), and line (6) in place of line (4).

What is claimed is:

1. A golf club head of a non-putter golf club comprising a crown and a sole located opposite the crown, a heel end and a toe end located opposite the heel end, a striking surface, and a design applied to the crown, which design comprises:

a vertical line parallel to the striking surface, and a first set of diagonal lines consisting of one or more entirely straight lines, wherein:

a) none of the lines of the first set of diagonal lines is parallel or perpendicular to the vertical line, b) no two lines of the first set of diagonal lines are parallel or perpendicular to each other, c) each line of the first set of diagonal lines forms an acute angle with a plane parallel to the striking surface, which plane passes through the endpoint of said line located nearer to the striking surface, and d) the lines of the first set of diagonal lines converge towards the heel end, and diverge towards the toe end.

2. The golf club head of claim 1, wherein the golf club is a driver, a fairway wood, a rescue club or a utility club.

3. The golf club head of claim 1, wherein the first set of diagonal lines comprises at least 2 lines.

4. The golf club head of claim 3, wherein the first set of diagonal lines comprises at least 3 lines.

5. The golf club head of claim 1, wherein the vertical line and all lines of the first set of diagonal lines intersect at or near a single point.

6. The golf club head of claim 5, wherein the vertical line and all lines of the first set of diagonal lines intersect at a single point.

7. The golf club head of claim 1, wherein each acute angle is open to the toe end.

8. The golf club head of claim 1, wherein each acute angle is about 3° to about 6°.

9. The golf club head of claim 1, wherein the vertical line has a thickness which varies along its length.

10. The golf club head of claim 1, wherein each line of the first set of diagonal lines has a thickness which varies along its length.

11. The golf club head of claim 1, wherein the vertical line has a color which differ from colors of each line of the first set of diagonal lines.

12. The golf club head of claim 1, wherein each line of the first set of diagonal lines has a color that differs from each other line of the first set of diagonal lines.

13. The golf club head of claim 1, wherein the design applied to the crown consists of the vertical line and the first set of diagonal lines.

14. The golf club head of claim 1, further comprising a second set of diagonal lines, said second set of diagonal lines consists of one or more entirely straight lines configured such that each line of the second set of diagonal lines is perpendicular to either the vertical line or to a line of the first set of diagonal lines.

15. The golf club head of claim 14, wherein each line of the second set of diagonal lines has a thickness which varies along its length.

16. The golf club head of claim 14, wherein each line of the second set of diagonal lines has a color that differs from each other line of the second set of diagonal lines.

17. The golf club head of claim 14, wherein the design applied to the crown consists of the vertical line, the first set of diagonal lines and the second set of diagonal lines.

18. The golf club head of claim 1, wherein the design consists of two-dimensional elements.

* * * * *